US005129464A

United States Patent [19]

Richier

[11] Patent Number: 5,129,464

[45] Date of Patent: Jul. 14, 1992

[54] SYSTEM FOR CONTROLLING A ROCK DRILL

[75] Inventor: Yves Richier, La Grand Croix, France

[73] Assignee: Secoma S.A., Meyzieu, France

[21] Appl. No.: 721,202

[22] Filed: Jun. 24, 1991

[30] Foreign Application Priority Data

Jun. 26, 1990 [FR] France ..... 90 08708

[51] Int. Cl.[5] ..... E21B 44/00

[52] U.S. Cl. ..... 173/1; 173/11; 173/32; 175/27

[58] Field of Search ..... 173/2, 11, 22, 31, 32, 173/33, 37, 1; 175/24, 27; 405/259, 260

[56] References Cited

U.S. PATENT DOCUMENTS

| | | | |
|---|---|---|---|
| 4,109,733 | 8/1978 | Dummer | 173/37 |
| 4,158,393 | 6/1979 | Kimber et al. | 173/2 |
| 4,158,520 | 6/1979 | Prebensen | 173/31 |
| 4,420,277 | 12/1983 | Hibbard et al. | 173/32 |
| 4,501,199 | 2/1985 | Mashimo et al. | 173/11 |
| 4,503,918 | 3/1985 | Bergkvist et al. | 175/27 |
| 4,537,263 | 8/1985 | Bjor | 173/11 |
| 4,848,485 | 7/1989 | Piipponen et al. | 175/27 |
| 4,854,397 | 8/1989 | Warren et al. | 175/27 |

*Primary Examiner*—Frank T. Yost

*Assistant Examiner*—Scott A. Smith

*Attorney, Agent, or Firm*—Herbert Dubno; Andrew M. Wilford

[57] ABSTRACT

A rock drill has a normally stationary base, a support movable longitudinally on the base forward toward and backward away from a rock face adjacent the base and having a part engageable forwardly with the face, a base actuator braced longitudinally between the base and the support for longitudinally moving the support on the base and for pressing the part of the support forward against the face with a predetermined anchoring force, a drill movable longitudinally on the support and having a drilling tool engageable in the face for drilling a longitudinal hole therein, and a drill actuator braced longitudinally between the drill and the support for longitudinally moving the drill on the support and for pressing the drilling tool longitudinally forward against the face adjacent the part with a predetermined drilling force. A pressure detector or sensor is provided on the part for producing an actual-value output corresponding to the reaction force or pressure exerted axially backward on the support by the face. A controller is connected between the pressure detector and the base actuator for varying the pressure exerted by same on the support and thereby maintaining the reaction pressure generally uniform.

7 Claims, 1 Drawing Sheet

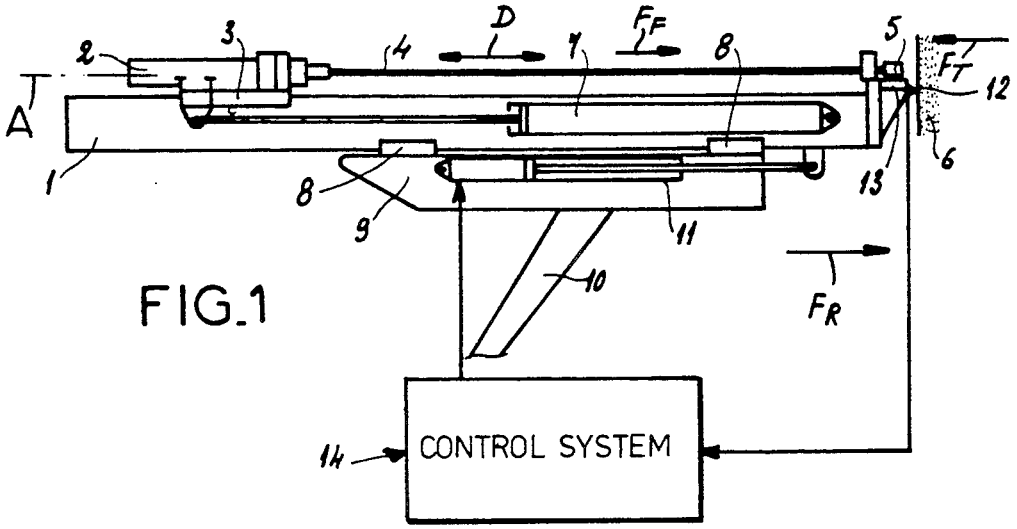
FIG.1
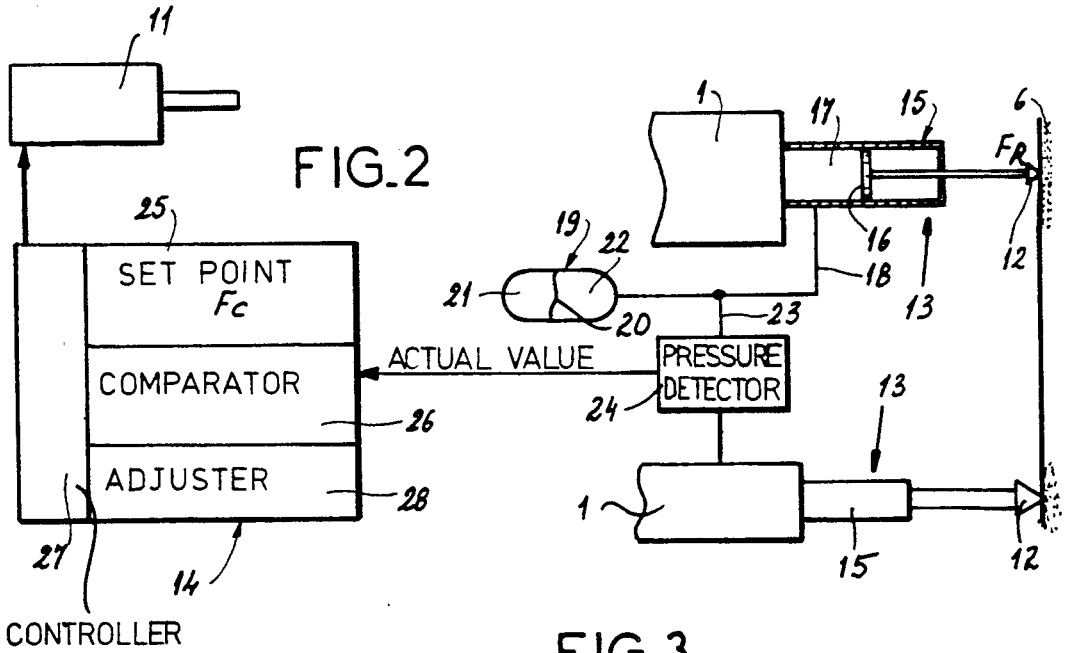
FIG.2
FIG.3
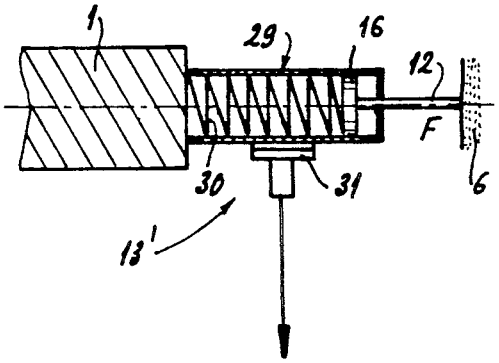

SYSTEM FOR CONTROLLING A ROCK DRILL

FIELD OF THE INVENTION

The present invention relates to a rock drill. More particularly this invention concerns a system for controlling the force with which the support of a rock drill is pressed against the rock it is drilling into.

BACKGROUND OF THE INVENTION

A standard rock drill has a main base that is carried on a positioning arm and that in turn carries a support that can move on this base in a predetermined longitudinal direction, with a main ram or actuator braced between the two parts for moving the support on the base longitudinally. The drill in turn can slide or roll longitudinally on this support with another actuator braced between the drill and the support to control its longitudinal movement. The drill carries a tool or bit that can be rotated, and often also reciprocated longitudinally slightly, for drilling into the rock face.

The standard procedure in such prior-art structures is to pressurize the main actuator to press the support against the wall with a predetermined very large anchoring force, whereupon the drill bit is brought to bear to form the hole. The drill itself is urged against the wall with a drilling force that is less than this large force and normally as great as the drilling bit can withstand. The two biasing forces are generally set by simple pressure-limiting valves connected between the respective actuators and a source of pressurized hydraulic liquid.

This system has several disadvantages:

The support can slip on the surface as the drill is being set up.

The rock face spalls where it is engaged by the support due to the considerable pressure exerted against it, particularly during drilling.

The drill can move during drilling.

As the drill bit encounters harder and softer material the anchoring force varies, thereby excessively stressing the rock face where the support engages it.

When the rock face is not perpendicular to the longitudinal drilling direction, which is invariably parallel to the direction of application of the anchoring force, it is very difficult to solidly position the support on the inclined face.

Drilling is generally inaccurate.

OBJECTS OF THE INVENTION

It is therefore an object of the present invention to provide an improved system for operating a rock drill.

Another object is the provision of such an improved system for operating a rock drill which overcomes the above-given disadvantages.

SUMMARY OF THE INVENTION

A rock drill has a normally stationary base, a support movable longitudinally on the base forward toward and backward away from a rock face adjacent the base and having a part engageable forwardly with the face, a base actuator braced longitudinally between the base and the support for longitudinally moving the support on the base and for pressing the part of the support forward against the face with a predetermined anchoring force, a drill movable longitudinally on the support and having a drilling tool engageable in the face for drilling a longitudinal hole therein, and a drill actuator braced longitudinally between the drill and the support for longitudinally moving the drill on the support and for pressing the drilling tool longitudinally forward against the face adjacent the part with a predetermined drilling force. A pressure detector or sensor is provided on the part for producing an actual-value output corresponding to the anchoring force or pressure exerted axially forward by the support on the face. A controller is connected between the pressure detector and the base actuator for varying the anchoring force exerted by the support by the face and thereby maintaining the reaction pressure generally uniform.

In accordance with this invention feedback is used to maintain this reaction force constant. A set point corresponding to a desired reaction pressure is generated and is compared with the actual-value output to generate an error signal that is in turn fed to the drill actuator.

Thus with this system the reaction force that is actually effective between the point part of the support and the rock face is monitored and is maintained generally constant. Thus before the bit is brought into contact with the rock face the anchoring force is identical to the set point. When drilling starts, however, the drilling force enters into play and is effective to push the support back off the rock face, opposite the anchoring force. Thus the following relationship holds:

$$F_T = F_R - F_F,$$

where $F_T$ = backward reaction force of the face on the support, $F_F$ = forward drilling force exerted by the drilling actuator on the drill, and $F_R$ = forward anchoring force exerted by the base actuator on the base.

According to a further feature of this invention the set point can be adjusted. This allows the system to be adjusted for different types of rock.

The detector of the present invention can be a hydraulic cylinder having a piston rod forming the part and a pressurizable fluid-filled chamber. A sensor connected to the chamber detects the fluid pressure in it and generates an output corresponding thereto. The detector can also be a strain gauge or can have a movable element extending from the part of the support, a spring biasing the element from the support into engagement with the face, and a sensor that detects the position of the element on the support.

For best operation in rock that is soft and/or likely to spall, at least one additional pressure detector like the first-mentioned pressure detector and offset therefrom on the part produces a respective actual-value output corresponding to the pressure exerted axially forward by the support on the face. The output of all the detectors are fed to the control means and averaged so that a weighted output can be made and used.

The invention is also a method of operating a rock drill of the above-described type. The method comprises first detecting the force with which the support bears at the part against the face and generating an actual-value output thereto. This output is then compared with a predetermined set point and the force the base actuator brings to bear on the support is varied in accordance with any variance between the set point and the actual-value output to maintain the actual-value output generally constant.

BRIEF DESCRIPTION OF THE DRAWING

The above and other objects, features, and advantages will become more readily apparent from the following, reference being made to the accompanying drawing in which:

FIG. 1 is a largely schematic side view of a rock drill according to this invention;

FIG. 2 is a schematic and partly sectional view of the control system in accordance with the invention; and FIG. 3 is a detail view of a variant on the system of FIG. 2.

SPECIFIC DESCRIPTION

As seen in FIG. 1 a rock drill according to this invention has a support 1 on which a hammer drill 2 is mounted via a slide 3 for movement in a longitudinal direction D parallel to a drill axis A. The drill 2 has a rod 4 extending along the axis A and carrying at its front end a bit or tool 5 that it drives with a forward drilling force $F_F$ into a vertical rock face 6. To this end an actuator 7 mounted on the support 1 has a piston rod connected to the drill 2 to bias it forward in the direction D with the constant drilling force $F_F$.

The support 1 in turn is slidable via guides 8 on a base 9 carried on a normally immovable arm 10 that itself normally extends from a tractor or the like that is not illustrated here. A point or tip 12 of the base 1 bears against the rock face 6 with an anchoring force $F_R$ that is established by another hydraulic actuator 11 that is mounted, like the actuator 7, on the base 9 and has its piston rod connected to the support 1. A sensor 13 is provided connected between the point or tip 12 and a control system 14 to monitor the axially backward reaction force $F_T$ that the rock face 6 exerts against this tip 12, this pressure $F_T$ being a function of the pressures $F_F$ and $F_R$. The pressure $F_F$ in turn is in part a function of the hardness of the rock face 6, since in relatively soft rock, for instance, the bit 5 will advance rapidly and the pressure $F_F$ will be reduced while in harder material the pressure $F_F$ will stay at or close to its maximum level.

FIG. 2 shows how the sensor 13 can be formed by a hydraulic cylinder 15 having a piston 16 whose rod carries the anchor point 12 and which defines a liquid-filled compartment 17 connected via a conduit 18 to an accumulator 19 having a membrane 20 dividing its interior into a gas chamber 21 and a liquid chamber 22. The liquid chamber 22 is connected to the conduit 18 and via another line 23 to a pressure detector 24 which produces as an output an electrical actual-value signal that it feeds to the control system 14. FIG. 2 illustrates how more than one such sensor 13 can be used to produce a weighted output.

As also shown in FIG. 2 this control system 14 comprises a memory 25 in which a set point Fc representing the desired back pressure $F_T$ is kept and a comparator 26 which compares this set point Fc to the actual value signal representing the actual back pressure $F_T$. The result, which may be changed by an adjuster 28 that can vary the set point Fc, is fed to a controller 27 which in turn feeds it to the actuator 11 that establishes the pressure $F_R$ in the cylinder 11.

The result is that the drill support will be urged against the rock face 6 with a pressure that is in fact a function of the pressures exerted by the two actuators 7 and 11, and that also is a function of how hard the material of the face 6 is.

FIG. 3 shows an arrangement wherein a sensor 13' comprises a cylinder 29 in which a piston like the piston 16 is biased outward by a spring 30 of known characteristic. A position detector 31 for the piston 16 produces an output that corresponds to pressure and that is fed to the comparator 26 in the manner described above.

Many variations on the inventive system are possible. For instance it is often advisable to use a plurality of sensors 13 so as to be able to average their outputs and thus achieve a weighted reading for work on softer materials. In addition the pressure detector can be otherwise constructed, for instance as a straightforward resistance-type strain gauge or the like.

I claim:

1. A rock drill comprising:

a normally stationary base;

a support movable longitudinally on the base forward toward and backward away from a rock face adjacent the base and having a part engageable forwardly with the face;

a base actuator braced longitudinally between the base and the support for longitudinally moving the support on the base and for pressing the part of the support forward against the face with a predetermined anchoring force;

a drill movable longitudinally on the support and having a drilling tool engageable in the face for drilling a longitudinal hole therein;

a drill actuator braced longitudinally between the drill and the support for longitudinally moving the drill on the support and for pressing the drilling tool longitudinally forward against the face adjacent the part with a predetermined drilling force, whereby the face bears backward against the support when the drill is engaging the face with a reaction force that is a function of the anchoring force, of the drilling force, and of the composition of the face;

means including a pressure detector on the part for producing an actual-value output corresponding to the reaction force; and control means connected between the pressure detector and the base actuator for varying the anchoring force and thereby maintaining the reaction force generally uniform.

2. The rock drill defined in claim 1 wherein the control means includes means for generating a set point corresponding to a desired pressure; and means for comparing the set point with the actual-value output and generating an error signal that is in turn fed to the drill actuator.

3. The rock drill defined in claim 2 wherein the control means further comprises means for adjusting the set point outputted by the generating means.

4. The rock drill defined in claim 1 wherein the detector includes:

a hydraulic cylinder having a piston rod forming the part and a pressurizable fluid-filled chamber; and means for detecting fluid pressure in the chamber and generating an output corresponding thereto.

5. The rock drill defined in claim 1, further comprising at least one additional pressure detector like the first-mentioned pressure detector and offset therefrom on the part for producing a respective actual-value output corresponding to the pressure exerted axially forward by the support on the face, both detectors being connected to the control means.

6. The rock drill defined in claim 1 wherein the detector includes:

a movable element extending from the part of the support;

a spring biasing the element from the support into engagement with the face; and means for detecting the position of the element on the support.

7. A method of operating a rock drill comprising:

a normally stationary base;

a support movable longitudinally on the base forward toward and backward away from a rock face adjacent the base and having a part engageable forwardly with the face;

a base actuator braced longitudinally between the base and the support for longitudinally moving the support on the base and for pressing the part of the support forward against the face with a predetermined anchoring force;

a drill movable longitudinally on the support and having a drilling tool engageable in the face for drilling a longitudinal hole therein; and a drill actuator braced longitudinally between the drill and the support for longitudinally moving the drill on the support and for pressing the drilling tool longitudinally forward against the face adjacent the part with a predetermined drilling force, whereby the face bears backward against the support when the drill is engaging the face with a reaction force that is a function of the anchoring force, of the drilling force, and of the composition of the face; the method comprising the steps of:

detecting the reaction force and generating an actual-value output thereto;

comparing the output with a predetermined set point; and varying the anchoring force the base actuator in accordance with any variance between the set point and the actual-value output to maintain the actual-value output generally constant.

* * * * *